US006138064A

United States Patent [19]

Matsumoto et al.

[11] Patent Number: 6,138,064

[45] **Date of Patent: *Oct. 24, 2000**

[54] METHOD OF AUTOMATICALLY CONTROLLING TRAVELING OF VEHICLE

[75] Inventors: Shinichi Matsumoto, Mihara; Akira Tagaki, Tokyo; Hiroyuki Mochidome; Hiroshi Saeki, both of Mihara, all of Japan

[73] Assignee: Mitsubishi Heavy Industries, Ltd., Tokyo, Japan

[ * ] Notice: This patent is subject to a terminal disclaimer.

[21] Appl. No.: 09/077,609

[22] PCT Filed: Oct. 1, 1997

[86] PCT No.: PCT/JP97/03496

§ 371 Date: Jun. 2, 1998

§ 102(e) Date: Jun. 2, 1998

[87] PCT Pub. No.: WO98/14359

PCT Pub. Date: Apr. 9, 1998

[30] Foreign Application Priority Data

Oct. 2, 1996 [JP] Japan ..... 8-261893

[51] Int. Cl.[7] ..... G08G 1/00

[52] U.S. Cl. ..... 701/23; 318/587

[58] Field of Search ..... 701/23, 24, 25, 701/26, 96, 300, 301; 340/903, 435, 436; 342/455; 180/167, 168, 169; 318/587

[56] References Cited

U.S. PATENT DOCUMENTS

| | | | |
|---|---|---|---|
| 3,941,201 | 3/1976 | Hermann et al. | 180/98 |
| 4,965,583 | 10/1990 | Broxmeyer | 342/42 |
| 5,179,329 | 1/1993 | Nishikawa et al. | 701/24 |
| 5,267,173 | 11/1993 | Tanizawa et al. | 701/24 |
| 5,297,049 | 3/1994 | Gurmu et al. | 701/24 |
| 5,331,561 | 7/1994 | Barrett et al. | 701/96 |
| 5,369,591 | 11/1994 | Broxmeyer | 701/24 |
| 5,675,518 | 10/1997 | Kuroda et al. | 701/96 |
| 5,777,451 | 7/1998 | Kobayshi et al. | 701/23 |
| 5,928,294 | 7/1999 | Zelinkovsky | 701/24 |
| 5,936,517 | 8/1999 | Yeh | 701/301 |
| 5,999,874 | 12/1999 | Winner et al. | 701/96 |

FOREIGN PATENT DOCUMENTS

| | | |
|---|---|---|
| 50-30496 | 3/1975 | Japan . |
| 54-67905 | 5/1979 | Japan . |
| 54-72806 | 6/1979 | Japan . |
| 54-88607 | 7/1979 | Japan . |
| 54-93506 | 7/1979 | Japan . |
| 56-95766 | 8/1981 | Japan . |
| 56-123702 | 9/1981 | Japan . |
| 9513948A2 | 5/1995 | WIPO . |

OTHER PUBLICATIONS

Thomas T H: "Control Techniques for PRT," Railway Gazette Interntional, vol. 130, No. 1, Jan. 1, 1974, pp. 15–17.

*Primary Examiner*—Gary Chin

[57] ABSTRACT

A running section on a main line 5 and a branching lane 7, leading to platforms 6, including a branching and merging is represented as a moving target control section 11. The running section of the main lane not including the branching and merging sections is represented as a vehicle-to-vehicle distance control section 12. When a vehicle enters the moving target control section 11, the vehicle is detected by a vehicle detector 13 and the position information, course information, etc., are output to an operation control computer. Based on the detected information the operation control computer temporarily shifts the generation interval of the moving target to be matched to an entry of the vehicle.

12 Claims, 3 Drawing Sheets

METHOD OF AUTOMATICALLY CONTROLLING TRAVELING OF VEHICLE

This application claims the benefit under 35 U.S.C. §371 of prior PCT International Application No. PCT/JP97/03496 which has an International filing date of Oct. 1, 1997 which designated the United States of America, the entire contents of which are hereby incorporated by references.

TECHNICAL FIELD

The present invention relates to a method for automatically controlling the running of vehicles.

BACKGROUND ART

Conventionally, the method for automatically controlling the running of vehicles on a road is generally classified into a "moving target" method (hereinafter, referred to as an MT method) and a vehicle-to-vehicle distance method.

The MT method comprises controlling the running of a real vehicle on a real road so as to follow an imaginary target (moving target) running on an imaginary road in a computer. That is, the MT method, as shown in FIG. 1, assumes a road 1, in the computer, equivalent to a real road and comprises setting points MTS 2 for enabling an ideal running to be achieved at a given interval on the running road 1, and running them and making control for enabling a real vehicle on the real road to follow the MT 2.

As a practical application of the MT method, there is a vehicle for sight-seeing around an exposition place. By taking it as an example, the conventional MT method will be explained below. As shown in FIG. 2, a main lane 5 is created as a loop-like lane and branch lanes 7 are created at proper intervals, each leading to a platform 6 where passengers can get on or get off the vehicle. Here, the platform 6 is typically for a station. The branch lane 7 again merges past the platform 6 onto the main lane 5. FIG. 3 is an enlarged view showing the platform 6 and branch lane 7. In FIGS. 2 and 3, reference numeral 8 represents a branching point, and 9 a merging point, 8*a* a decelerating lane constituting a lane from the branching point 8 to the platform 6, and 9*a* an accelerating lane from the platform 6 to the merging point 9.

As shown in FIGS. 2 and 3, position information equipments 10 and communications equipments are provided along the main lane 5 over a full length to communicate with the vehicles and the vehicle is operated in accordance with a target signal issued from the position information equipment 10.

In order to enable the vehicle, which leaves the platform 6 to join the main lane 5, control is made to enable the vehicle to depart from the platform 6 just in a timing to acquire the target MT 2 at the merging point 9 or all the MTs 2, which are allocated to respective vehicles to be delayed.

That is, in the conventional MT method, irrespective of whether the vehicle approaches to the running road (main lane), the target MT 2 is generated at a given interval and the vehicle is controlled enable the vehicle to follow the target M2. The MT control method above constitutes a positive control method, but it is necessary to provide the position information equipment and communications equipment over the full length of the running road. Therefore, a larger-sized computer system is required to control this.

There is an increasing demand for a long-distance non-attendant transportation system in view of a recent increase in transportation quantity and a man-power shortage. If the MT method is adopted over the full length of the long-distance running road, the equipment cost becomes vast.

On the other hand, a vehicle-to-vehicle distance control method comprises mounting a vehicle-to-vehicle distance measuring device on each vehicle and operating the vehicle, while maintaining a proper distance between the vehicles, so that any collision may be prevented from occurring. This system has been extremely high in performance in a recent advance in the laser technique and in electronic technique. The system above has only to be equipped with a measuring device for each vehicle and any equipments, as in the MT method, need not be provided over the full length of the road, so that an economic advantage can be gained in view of a long distance to be covered.

The system, however, still ensures no adequate reliability at those branching points and merging points on the running road where vehicles are closely crowded and it is necessary to perform a complex maneuver.

The conventional MT method presents the following problems because the target MT is generated at a given interval irrespective of any entry of the vehicle.

(1) If any MT control is made over the full range of the running road, it is necessary to provide the position information equipment and communication lines for an entire road. Because a larger computer is required for this control, the equipment cost becomes greater.

(2) The vehicles do not always enter or join the MT control section just in a timing to be matched to the target MT.

(3) In the case where the vehicle enters or joins in a different timing from the generation of the target MT, it is necessary to temporarily decelerate the vehicle to acquire a matching between the vehicle and the target MT. In the case where the vehicles are operated in a continuous way, it is necessary to sequentially decelerate those subsequently following vehicles in which case a cause for a disturbance is introduced in the control of the vehicles.

In the vehicle-to-vehicle distance control method, on the other hand, an associated device has only to be provided for each vehicle and it is not necessary to provide the equipments over a full length of the running road as in the MT method. Therefore, an economic advantage is gained in view of a long distance covered, but no adequate reliability is gained on the road at a branching points and merging points where vehicles are closely crowed together or a complex maneuver is necessary.

It is accordingly, the object of the present invention to provide a running vehicle control method which can make a computer compact and a cost lower, obviate the need to decelerate the vehicle upon entering or joining the target MT control section, avoid a disturbance in the control of the vehicle and ensure high reliability.

DISCLOSURE OF THE INVENTION

The above-mentioned object of the present invention is achieved by the following methods.

That is, the present invention provides a method for controlling the automatic runnings of a plurality of vehicles on a road comprising main and branching lanes, characterizing in that the vehicle on a section of the running road, including a branching point and a merging point, is run-controlled by a moving target method for controlling the running of a real vehicle on a real road so as to follow a moving target running on an imaginary running road of a computer, and the vehicle running on that section of the road, not including such branching point and merging point, is run-controlled by a vehicle-to-vehicle distance control method for measuring a distance to a forwardly running vehicle by a distance measuring device mounted on the vehicle and controlling the running of the vehicle so as to maintain the vehicle-to-vehicle distance above a set value.

Further, a method is provided for controlling the automatic runnings of a plurality of vehicles on a road comprising main and branching lanes, characterizing in that the vehicle running on a section of the road, including a branching point and merging point, is run-controlled by a moving target method for controlling the running of a real vehicle on a real road so as to follow a moving target running on an imaginary road in a computer;

the vehicle running on that section of the running road, not including such branching point and merging point, is run-controlled by a vehicle-to-vehicle distance control method for measuring a distance to a forwardly running vehicle by a distance measuring device mounted on the vehicle and controlling the running of the vehicle so as to maintain the vehicle-to-vehicle distance above a set value; and when the vehicle enters into a main lane section of the running path, not including the branching point and merging point, the generation period of the imaginary target is temporarily shift-controlled so as to be matched to the entry of the vehicle.

Still further, a method is provided for controlling the automatic runnings of a plurality of vehicles on a road comprising main and branching lanes, characterizing in that the vehicle running on a section of the road, including a branching point and merging point, is run-controlled by a moving target method for controlling the running of a real vehicle on a real road so as to follow a moving target running on an imaginary road in a computer;

the vehicle running on that section of the road, not including such branching point and merging point, is run-controlled by a vehicle-to-vehicle distance control method for measuring a distance to a forwardly running vehicle by a distance measuring device mounted on the vehicle and controlling the running of the vehicle so as to maintain the vehicle-to-vehicle distance above a set value; and when, onto the vehicle running on the main lane section of the road, not including the branching point and merging point, another vehicle joins from the branching lane, the moving target method shift-controls the generation of the imaginary target of said another vehicle so as to enable the imaginary target of said vehicle to be matched to the imaginary target of said another vehicle.

By controlling the running of the vehicle on the running section involving branching and merging, by the moving target method, and on the remaining section by the vehicle-to-vehicle distance control method, it is possible that a position information equipment has only to be provided on the running section involving the branching and merging. Further, the computer for making the operation control of the vehicle controls the vehicle on the running control section alone by the moving target method and it is possible to make the computer smaller in size and greatly lower in cost.

Further, during the running control section of the vehicle by the moving target method, the moving target is generated in a timing to be matched to the entering or joining of the vehicle onto the running control section. By doing so, there is no need for such a time and decelerating distance as to match the entry of the vehicle to the moving target. Further, it is possible to avoid any vehicle control disturbance by the moving target method at the entry of the running control section.

BEST MODE OF CARRYING OUT THE INVENTION

Hereinbelow, one aspect of the present invention will be explained with respect to the drawings.

Figure 1:
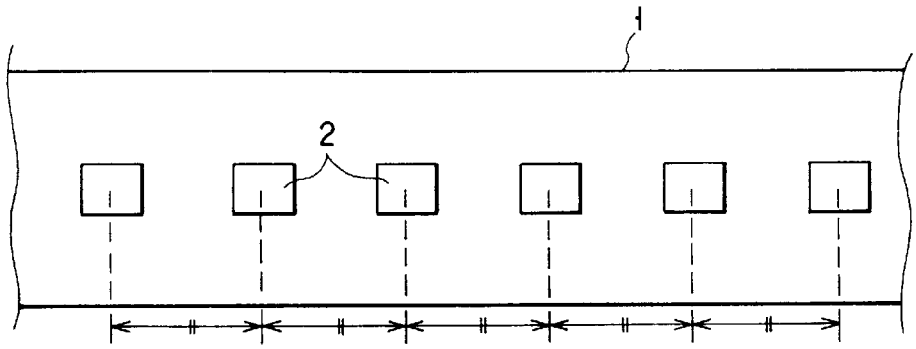
FIG. 1 is a view for explaining a moving target (MT) method.
Figure 2:
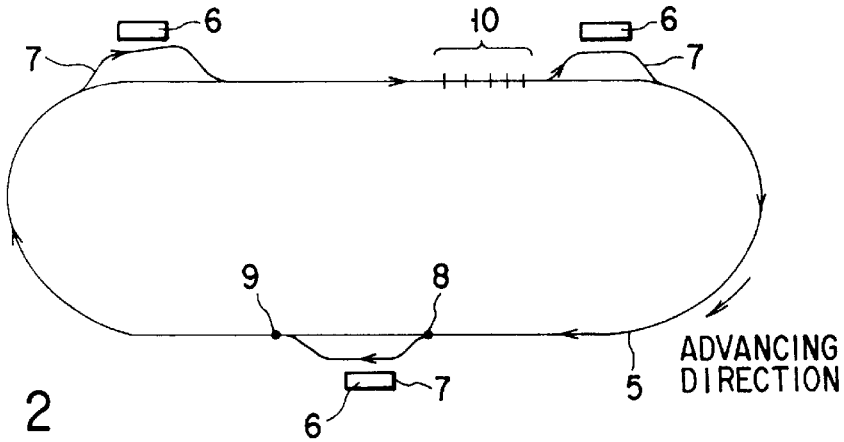
FIG. 2 is a view showing a practical application of a conventional MT method.
Figure 3:
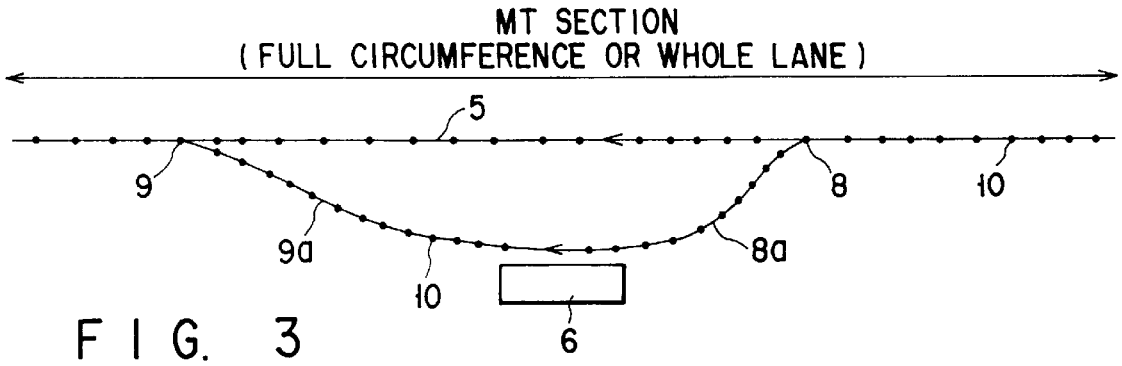
FIG. 3 is a view showing a detail of branching and merging sites between the main and branching lanes in FIG. 2.
Figure 4:
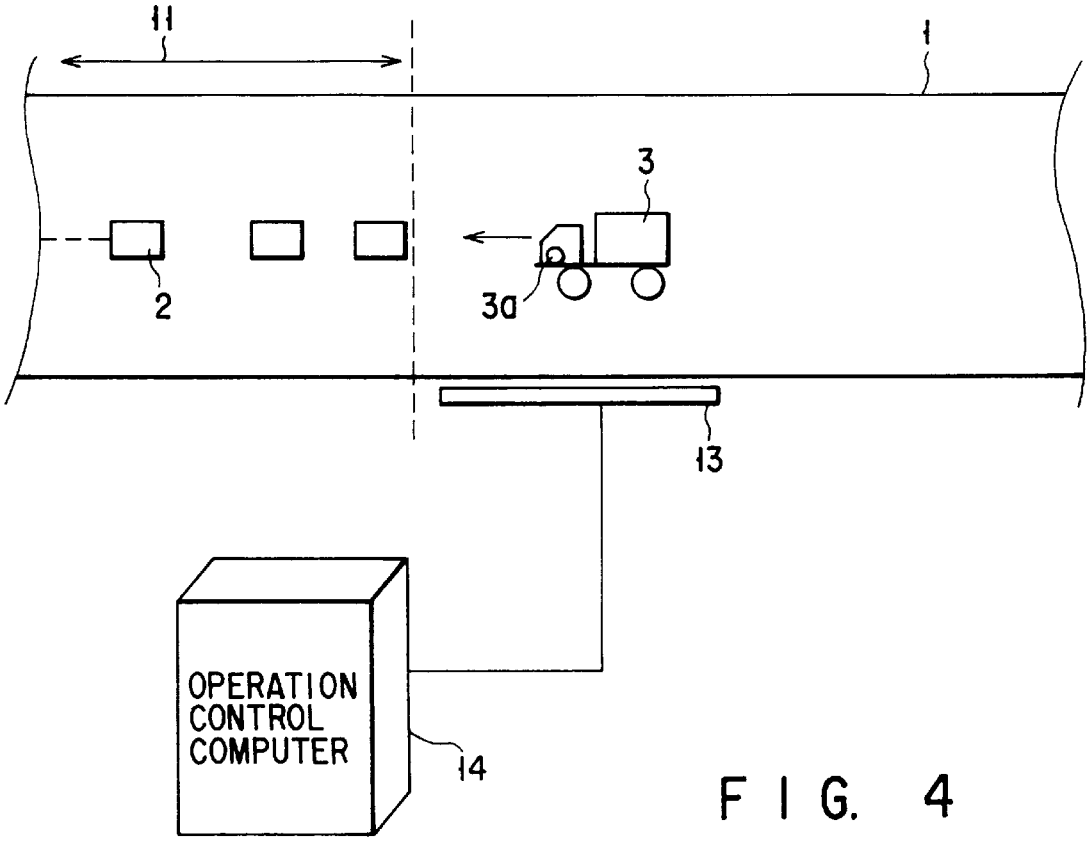
FIG. 4 is a schematic view showing a running vehicle control method according to one aspect of the present invention.
Figure 5A:
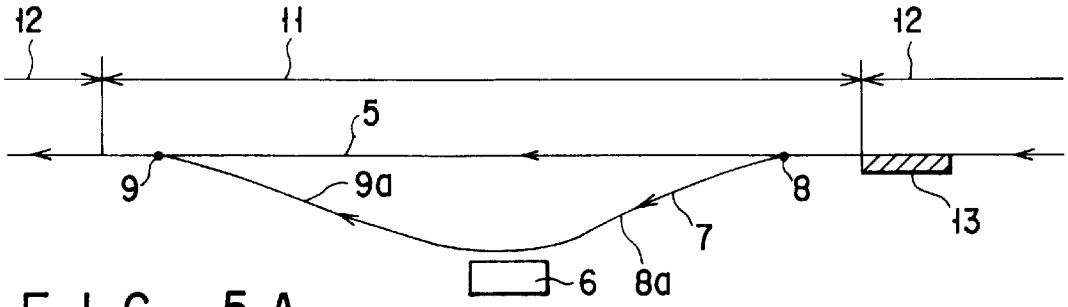
FIGS. 5A and 5B each are schematic views for showing a detail of an MT control section in the aspect above.
Figure 5B:
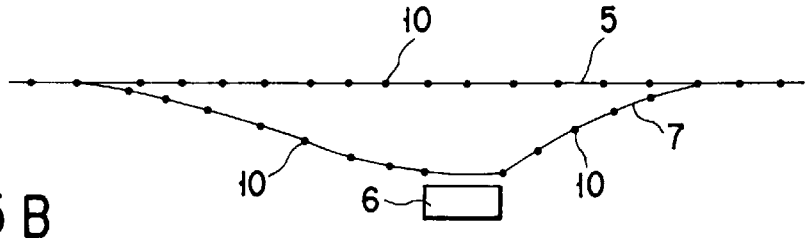

FIGS. 4, 5A, and 5B are schematic views showing a major section of a vehicle running control method according to one aspect of the present invention.

As shown in FIGS. 4, 5A, and 5B, an MT control section 11 and vehicle-to-vehicle distance control section 12 are provided on a road 1 along a rail. The road 1 includes branching lanes 7, branched at a proper interval from a main lane 5, leading to a platform 6, such as a station, where passengers gets on or get off the vehicle. The branching lane 7 again merges past the platform 6 onto the main lane 5. A decelerating lane 8*a* ranges from the branching point 8 between the main lane 5 and the branching lane 7 to the platform 6 and an accelerating lane 9*a* from the platform 6 to a merging point 9 for merging the main lane 5.

The MT control section 11 is defined to be a platform setting section including the branching point 8 between the main lane 5 and branching lane 7 and the merging line 9. And the vehicle-to-vehicle distance control section 12 is defined to be the remaining section, that is, a section not including the platform 6. Further, communications equipment and position information equipment 10 are provided at a given interval along the main and branching lanes 5 and 7 as shown in FIG. 5B to communicate with the vehicle. In the MT control section 11, a vehicle detector 13 is mounted in front of an entry to detect the position, speed, course, etc., of the running vehicle 3 and inputs them to an operation control computer 14. The operation control computer 14 controls the generation of the MT and the operation of the running vehicle 3 in the MT control section 11 on the basis of the input information, etc., from the vehicle detector 13. The respective vehicle 3 is equipped with a computer and stores, in the computer, the information of whether it be run on the main lane or branched when it is run through the MT control section 11. The respective vehicle has its own vehicle number set thereon.

Further, a distance measuring device 3*a*, such as a laser radar, is mounted on the vehicle 3 to measure a distance to an adjacent vehicle running in front of the vehicle 3. In the case where, when a vehicle is running on the vehicle-to-vehicle distance control section 12, it enters into a braking warning zone against another vehicle, it ensures that a vehicle approaching from behind can maintain a distance, that is a distance for it to avoid any rear-end collision, through the applying of a brake. That is, the vehicle-to-vehicle distance control system is adopted on the vehicle-to-vehicle distance section 12 other than the MT control section 11.

An explanation will be given below about the operation of the above-mentioned embodiment.

The vehicle 3 running on the vehicle-to-vehicle distance control section 12 is equipped with the distance measuring device 3*a* so as to measure the distance to a running vehicle in front and it can be run based on the measured distance information while properly maintaining their relative running distance. And when the vehicle 3 enters from the vehicle-to-vehicle distance control section 12 into the MT control section 11, the running position, speed, course, etc., are detected by the vehicle detector 13 and the detection information is sent to the operation control computer 14. The operation control computer 14, after the entry of the vehicle into the MT control section 11, determines, based on the detection information, whether the vehicle 3 is to be moved toward the branching lane 7 or to be moved straight on the main lane 5. In the case where the vehicle is running straight on the main lane 5, the operation control computer 14 can readily predict a timing in which it reaches the merging point 9.

Figure 6:
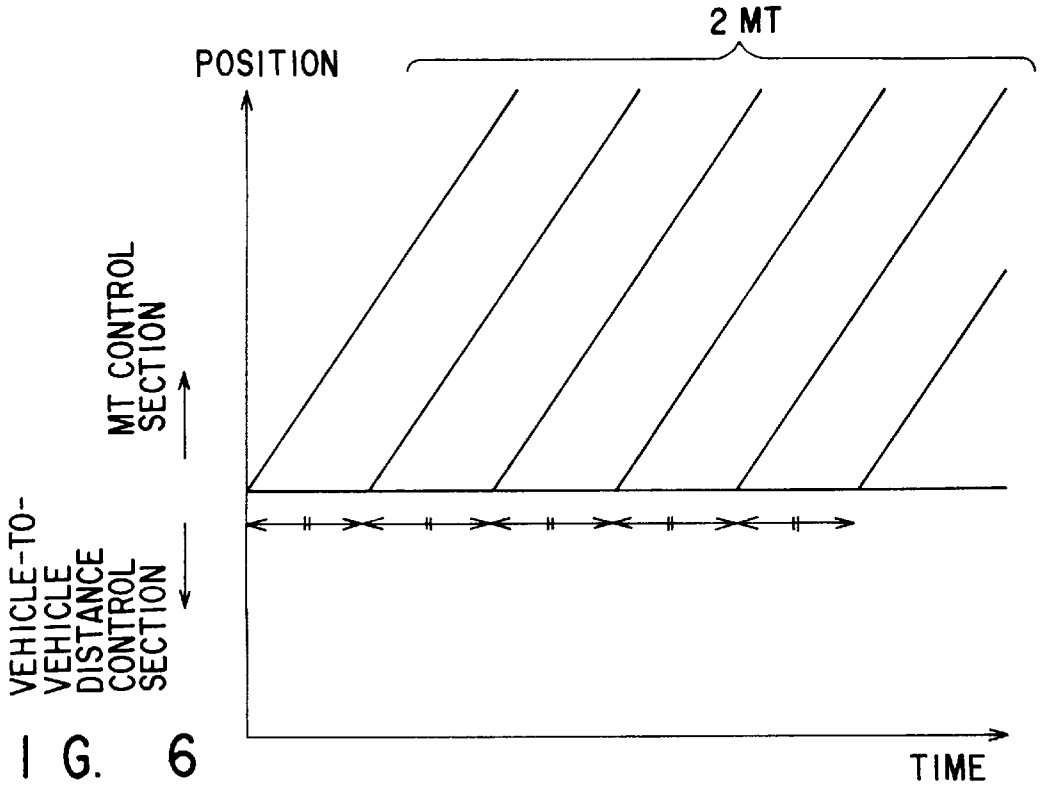
FIG. 6 shows a method for generating MTs at a normal time in the aspect above.
Figure 7:
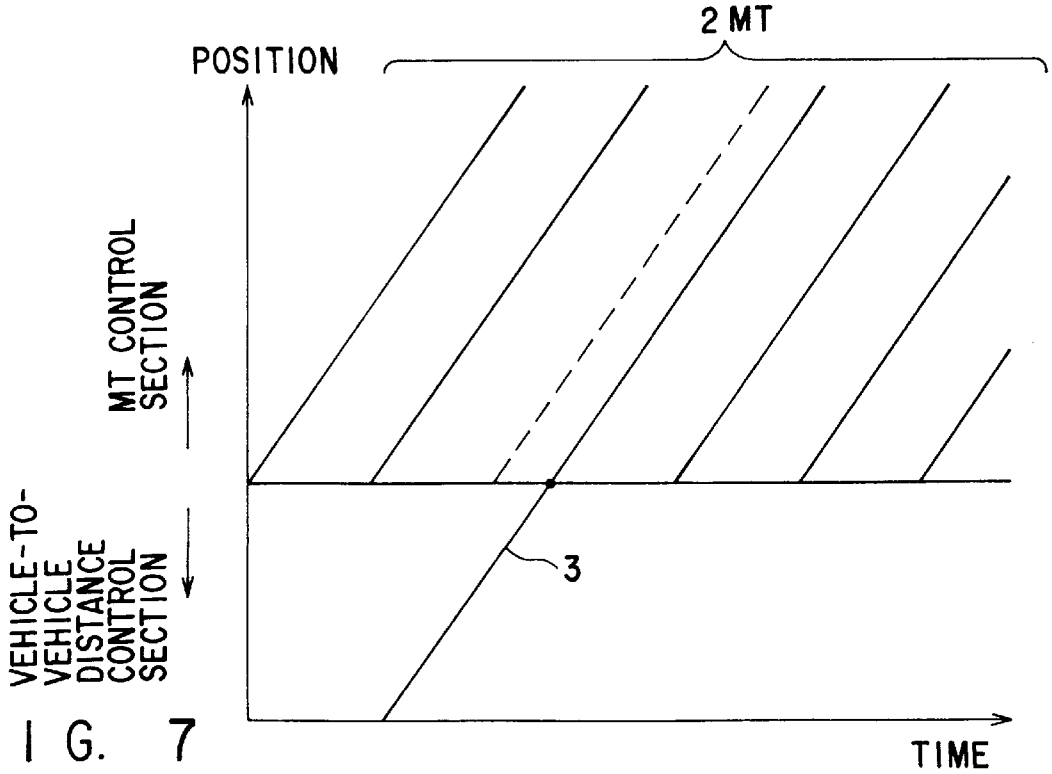
FIG. 7 shows a method for generating MTs when there exists a vehicle at an entry or a merging site in the aspect above.

The operation control computer 14 generates a target MT 2 at a given interval at a normal time as shown in FIG. 6 and, when the vehicle 3 enter the MT control section 11, a target MT 2 is generated, as shown in FIG. 7, in a timing in which the vehicle 3 enters there.

There are sometimes cases where vehicles 3 are entering, one after another, into the MT control section 11 in the same timing as, or in a shifted relation to, the MT 2. In order to regularly set these vehicles 3 entering one after another onto the MT control section 11, it is required that very complex control be made such as the deceleration of the vehicle 3. According to the present invention, on the other hand, the target MT 2 is generated in the timing to be matched to the entry of the vehicle 3. Thereafter, another target MT 2 is generated at a given interval again as in a normal time. The operation control computer 14 effects the operation control of the respective vehicles based on the position information of the running vehicles sequentially sent from the position information equipment 10.

In the case where the target MT 2 is shifted from the entry timing of the vehicle, the generation interval of the target MT 2 is temporarily shifted so as to be matched to the entry of the vehicle 3. By doing so, it is possible to operate the vehicle 3 regularly without being decelerated.

In the case where another vehicle joins the main lane 5 from the branching lane 7, an available target MT 2 is searched on the main lane 5 and the vehicle, while being accelerated on the accelerating lane with the MT 2 as a target, joins at the merging point 9.

At this time, joining is achieved at a merging point 9 between the merging MT on the main lane 5 and the to-be-merged MT on the accelerating lane and, if, however, the timing is shifted between the merging MT and the to-be-merged MT, the generation of the merging MT is temporarily shifted so as to secure a matching between both.

After the joining is achieved, the main lane is a single lane and each vehicle 3 after advancing from the MT control section 11 to the vehicle-to-vehicle distance control section 12 measures a distance by the distance measuring device to the forwardly moving vehicle and advances toward the next MT control section 11 while effecting the vehicle-to-vehicle distance control.

According to the present invention, as set out in more detail, running control is made by the MT method on the running section, on which the vehicle runs past the branching and merging sites, and by the vehicle-to-vehicle distance control method on the remaining section. Therefore, it is only necessary to provide the position information equipment only on the running section including the branching and merging sites. Further, the operation control computer controls the MT control section alone, so that the system can be made compact and largely lower in cost.

In the MT control section, the target MT is generated in a timing in which the vehicle runs onto the entry site or merging site. As a result, it is not necessary to prepare a time and decelerating distance taken for the entering vehicle to secure a matching to the MT. It is also possible to avoid any vehicle control disturbance at the entry of the MT control section.

INDUSTRIAL APPLICABILITY the present invention relates to a method for automatically controlling the runnings of a plurality of vehicles on the road and is of utility to a long distance non-attended transportation system.

What is claimed is:

1. A method for controlling automatic runnings of a plurality of vehicles on a road having main and branching lanes, comprising:

controlling a vehicle running in a MT running section of the road, including a branching point and a merging point, by a moving target method that controls running of a real vehicle on a real road to follow a moving target running on an imaginary road in a computer; and controlling the vehicle running in a section of the road, not including the branching point and the merging point by a vehicle-to-vehicle distance control method that measures a distance to a forwardly running vehicle by a distance measuring device mounted on the vehicle and controls the running of the vehicle to maintain the vehicle-to-vehicle distance above a set value.

2. The method according to claim 1, wherein, when the vehicle enters the main lane section of the road not including the branching point and the merging point, the moving target method temporarily shift-controls a generation interval of the moving target to be matched to the entry of the vehicle.

3. The method according to claim 1, wherein, when, onto the vehicle running in the main lane section of the road not including the branching point and the merging point, another vehicle joins from the branching lane, the moving target method shift-controls the generation of the moving target of said another vehicle to enable the moving target of said vehicle to be matched to that of said another vehicle.

4. The method according to claim 1, wherein the road is allocated a moving target MT control section to which the moving target method is applied and a vehicle-to-vehicle distance control section to which the vehicle-to-vehicle distance control method is applied.

5. The method according to claim 4, wherein the vehicle-to-vehicle distance control section is allocated to sections of the road other than the moving target control section.

6. The method according to claim 4, wherein an equipment is provided in the moving target MT control section to send and receive information to and from the vehicle running in said moving target MT control section.

7. The method according to claim 4, wherein a position information equipment is provided in the moving target MT control section to detect position information on the vehicle running on said moving target MT control section.

8. The method according to claim 4, wherein a vehicle detector for detecting a running position, speed, and course of the vehicle running in the vehicle-to-vehicle control section is provided at a boundary to the moving target MT control section of the vehicle-to-vehicle distance control section.

9. The method according to claim 1, wherein each vehicle has a distance measuring device mounted to measure a distance to a forwardly running vehicle.

10. The method according to claim 1, wherein each vehicle has a computer mounted to store at least information representing a passage of the vehicle in the MT running section and branching of the vehicle from the MT running section.

11. The method according to claim 1, wherein each vehicle has its own vehicle number set thereon.

12. The method according to claim 1, wherein the moving target method and the vehicle-to-vehicle distance control method are executed by an operation control computer.

* * * * *

UNITED STATES PATENT AND TRADEMARK OFFICE

CERTIFICATE OF CORRECTION

PATENT NO. : 6,138,064
DATED : October 24, 2000
INVENTOR(S) : Shinichi Matsumoto et al.

It is certified that error appears in the above-identified patent and that said Letters Patent is hereby corrected as shown below:

Please delete the section "[*] Notice: This patent is subject to a terminal disclaimer."

Signed and Sealed this

Thirtieth Day of October, 2001

*Attest:*

Nicholas P. Godici

NICHOLAS P. GODICI
*Acting Director of the United States Patent and Trademark Office*

*Attesting Officer*